US011123628B2

(12) United States Patent
Frappier

(10) Patent No.: US 11,123,628 B2
(45) Date of Patent: Sep. 21, 2021

(54) SNOWBOARD BINDING HAVING AUXETIC COMPONENTS

(71) Applicant: Low Pressure Studio B.V., Amsterdam (NL)

(72) Inventor: Justin Frappier, South Burlington, VT (US)

(73) Assignee: Low Pressure Studio B.V., Amsterdam (NL)

( * ) Notice: Subject to any disclaimer, the term of this patent is extended or adjusted under 35 U.S.C. 154(b) by 23 days.

(21) Appl. No.: 16/694,200

(22) Filed: Nov. 25, 2019

(65) Prior Publication Data

US 2021/0154563 A1 May 27, 2021

(51) Int. Cl.
*A63C 10/06* (2012.01)
*A63C 10/00* (2012.01)
*A63C 10/24* (2012.01)

(52) U.S. Cl.
CPC ..... *A63C 10/06* (2013.01); *A63C 10/005* (2013.01); *A63C 10/24* (2013.01)

(58) Field of Classification Search
CPC ..... A63C 10/06; A63C 10/005; A63C 10/24
See application file for complete search history.

(56) References Cited

U.S. PATENT DOCUMENTS 8,084,117 B2 12/2011 Lalvani
9,538,798 B2 1/2017 Toronjo
9,629,397 B2 4/2017 Toronjo
9,936,755 B2 4/2018 Blakely et al.
9,949,518 B2 4/2018 Toronjo
2002/0089151 A1* 7/2002 Carrasca ..... A63C 10/06 280/617
2006/0175802 A1* 8/2006 Maravetz ..... A63C 10/06 280/619
2009/0146396 A1* 6/2009 Hahnenberger ..... A63C 10/06 280/617
2009/0146397 A1* 6/2009 Steere ..... A63C 10/24 280/624
2014/0059734 A1* 3/2014 Toronjo ..... A41D 1/00 2/69
2014/0101816 A1* 4/2014 Toronjo ..... A45F 3/12 2/69
2014/0109286 A1* 4/2014 Blakely ..... A41D 31/04 2/69
2014/0237850 A1* 8/2014 Hull ..... A43C 1/003 36/11.5
2016/0374886 A1* 12/2016 Wyatt ..... A61H 7/007 601/18
2017/0035147 A1* 2/2017 Farris ..... A43B 23/027
2020/0221816 A1* 7/2020 Morgan ..... A43B 13/187

* cited by examiner

*Primary Examiner* — Brian L Swenson
(74) *Attorney, Agent, or Firm* — Burns & Levinson LLP; Daniel McGrath

(57) ABSTRACT

A snowboard binding including a highback and a plurality of straps. The highback forms an inward curve to define a cavity for a boot. A plurality of straps secure the boot in the cavity, the straps including a toe strap and an ankle strap. At least one of the highback, the toe strap, or the ankle strap have a section with an auxetic pattern.

12 Claims, 11 Drawing Sheets

SNOWBOARD BINDING HAVING AUXETIC COMPONENTS

FIELD OF THE TECHNOLOGY

The subject disclosure relates to sporting equipment, and more particularly to snowboard bindings.

BACKGROUND OF THE TECHNOLOGY

Toe and ankle straps of a snowboard binding are designed to hold a snowboard boot to the snowboard. The more anatomically shaped these bindings straps are, the better they hold the boot to the snowboard. Additionally the more they are connected and close fitting, the more direct the energy transfer will be from boot to binding and to board. When straps are designed to conform to the boot, the materials are less likely to fail since the part stress is reduced through better surface pressure distribution. However, it is difficult for a snowboard strap to conform closely to both the snowboard boot and binding while still maintaining comfort and performance for a rider.

Snowboard highbacks are typically solid plastic with holes or coring to add lightness, aesthetic technical appeal, and targeted softer or flexible regions. No matter the quantity or size of holes typically used on a highback, the material is always flexed and stressed when loaded, which gives rise to concerns of breakage that can be difficult to address while still keeping the material light and flexible.

Therefore there is a need for a snowboard binding which minimizes stress while still providing support and comfort for the rider.

SUMMARY OF THE TECHNOLOGY

In light of the needs described above, the subject technology implements snowboard bindings which utilize auxetic patterns in certain areas to provide a balanced solution to concerns of tightness, flexibility, strength, and comfort, among other things.

In at least one aspect, the subject technology relates to a snowboard binding includes a highback configured to form an inward curve to define a cavity for a boot. The binding also includes at least one strap configured to secure the boot within the cavity. Either the highback or the at least one strap includes an auxetic pattern.

In at least one aspect, the subject technology relates to a snowboard binding having a highback, an ankle strap, and a toe strap. The highback is configured to form an inward curve to define a cavity for a boot. The ankle strap is configured to extend across the cavity and connect to the medial and lateral sides of the binding chassis (referred to as heelcup, heelhoop, baseplate, chassis, or the like, depending on brand or person, and referred to generally as the binding) on opposite sides of the inward curve to secure the boot within the cavity. The toe strap is configured to extend across a toe region of the boot to secure the boot within the cavity. Either or both of the ankle strap and toe strap include a section with an auxetic pattern.

In some embodiments, the toe strap includes a first solid perimeter surrounding a first interior portion, the first interior portion forming an auxetic pattern. The auxetic pattern of the toe strap can be formed from a plurality of apertures through the toe strap, the plurality of apertures having a size based on proximity to the solid perimeter, with apertures more proximate to the solid perimeter having a smaller size. The solid perimeter of the toe strap can have a greater rigidity than the first interior such that the solid perimeter of the toe strap resists expansion as compared to the first interior.

In some embodiments, the ankle strap includes a solid perimeter surrounding a second interior, the second interior forming an auxetic pattern. The highback can have a lower portion proximate to a heelcup and an upper portion distal the heelcup, the upper portion including an auxetic pattern. In some cases, the auxetic pattern can be a hinge pattern with hinges formed between structural material, the hinges configured to flex in a direction orthogonal to a plane of the structural material. Further, in some cases, the hinge pattern is formed by a first and second plurality of strips. The first plurality of strips extends in a series of U-shaped arcs along a first axis of the plane. The second plurality of strips extends in a series of U-shaped arcs along a second axis of the plane and intersecting with the first plurality of strips, the second axis being orthogonal to the first axis.

In at least one aspect, the subject technology relates to a snowboard binding having a baseplate, a highback, a toe strap, and an ankle strap. The baseplate is configured to mount the snowboard binding to a snowboard. The highback is configured to attach to the baseplate and has an inward curve forming a cavity configured to encircle a boot. The highback has a first portion having a heelcup configured to support a heel region of the boot and a second portion distal to the heelcup, the second portion including an auxetic pattern. The toe strap is configured to extend across a toe region of the boot and connect to the baseplate at opposite sides of the boot to secure the boot within the cavity. The toe strap includes a first solid perimeter surrounding a first interior, the first interior forming a first auxetic pattern. The ankle strap is configured to extend across the cavity, extend across an ankle region of the boot, and connect to the binding chassis (e.g., the baseplate, heelcup, or the like) at opposite sides of the inward curve to secure the rider's ankle within the cavity. The ankle strap includes a second solid perimeter surrounding a second interior, the second interior forming a second auxetic pattern.

In some embodiments the toe strap is configured such that when a boot is secured within the cavity, pressure applied to the toe strap by the boot causes the auxetic pattern of the first interior to apply a downward force to a top surface of a toe region of the boot and an inward force to a front surface of the toe region of a boot to cup the toe region and force the boot in a direction of the heelcup. In some cases the auxetic patterns are formed from a plurality of apertures surrounded by supporting material. The apertures of the auxetic pattern of the toe strap can have a size based on proximity to the first solid perimeter, with apertures more proximate to the solid perimeter having a smaller size.

In some embodiments, the toe strap is relatively rigid nearer the first solid perimeter to resist stretching in a general plane of the toe strap while being relatively flexible nearer a center of the first interior to allow stretching in a direction perpendicular to the general plane of the toe strap. In some cases, the ankle strap is relatively rigid nearer the second solid perimeter to resist stretching in a general plane of the ankle strap while being relatively flexible nearer a center of the second interior to allow stretching in a direction perpendicular to the general plane of the ankle strap. In some cases, in at least one of the auxetic patterns, a plurality of apertures proximate a central region of said auxetic pattern each include three prongs extending from a central portion of the aperture. In some cases, the second portion of the highback includes an inner edge and an upper edge and the auxetic pattern runs adjacent to the entire inner edge and upper edge of the highback.

BRIEF DESCRIPTION OF THE DRAWINGS

So that those having ordinary skill in the art to which the disclosed system pertains will more readily understand how to make and use the same, reference may be had to the following drawings.

DETAILED DESCRIPTION

Figure 1:
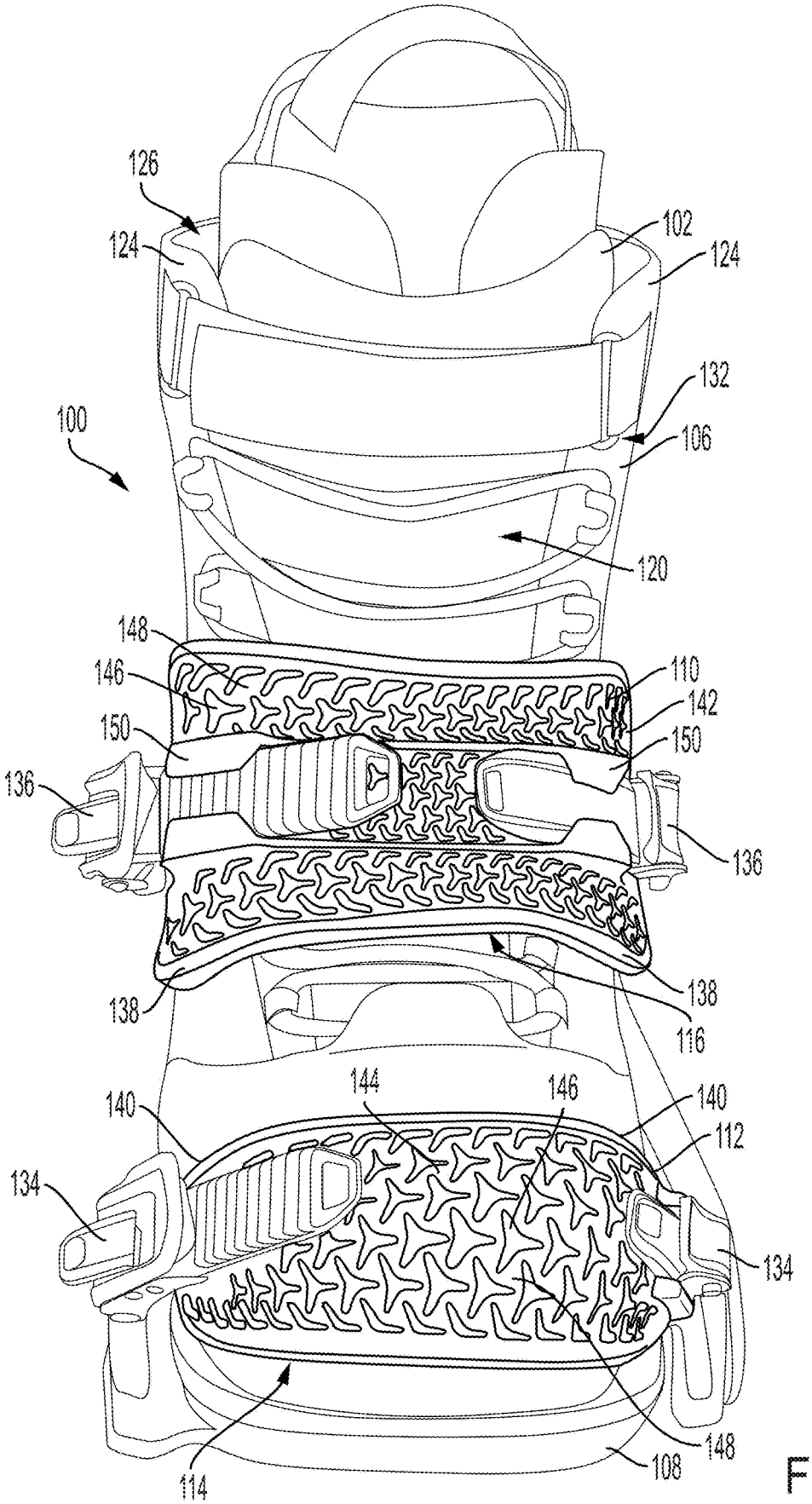
FIG. 1 is a front view of a snowboard binding in accordance with the subject technology securing a boot.

The subject technology overcomes many of the prior art problems associated with snowboard bindings. In brief summary, the subject technology provides a snowboard binding utilizing auxetic patterns to improve performance. The advantages, and other features of the systems and methods disclosed herein, will become more readily apparent to those having ordinary skill in the art from the following detailed description of certain preferred embodiments taken in conjunction with the drawings which set forth representative embodiments of the present invention. Like reference numerals are used herein to denote like parts. Further, words denoting orientation such as "upper", "lower", "distal", and "proximate" are merely used to help describe the location of components with respect to one another. For example, an "upper" surface of a part is merely meant to describe a surface that is separate from the "lower" surface of that same part. No words denoting orientation are used to describe an absolute orientation (i.e. where an "upper" part must always be on top).

Figure 2:
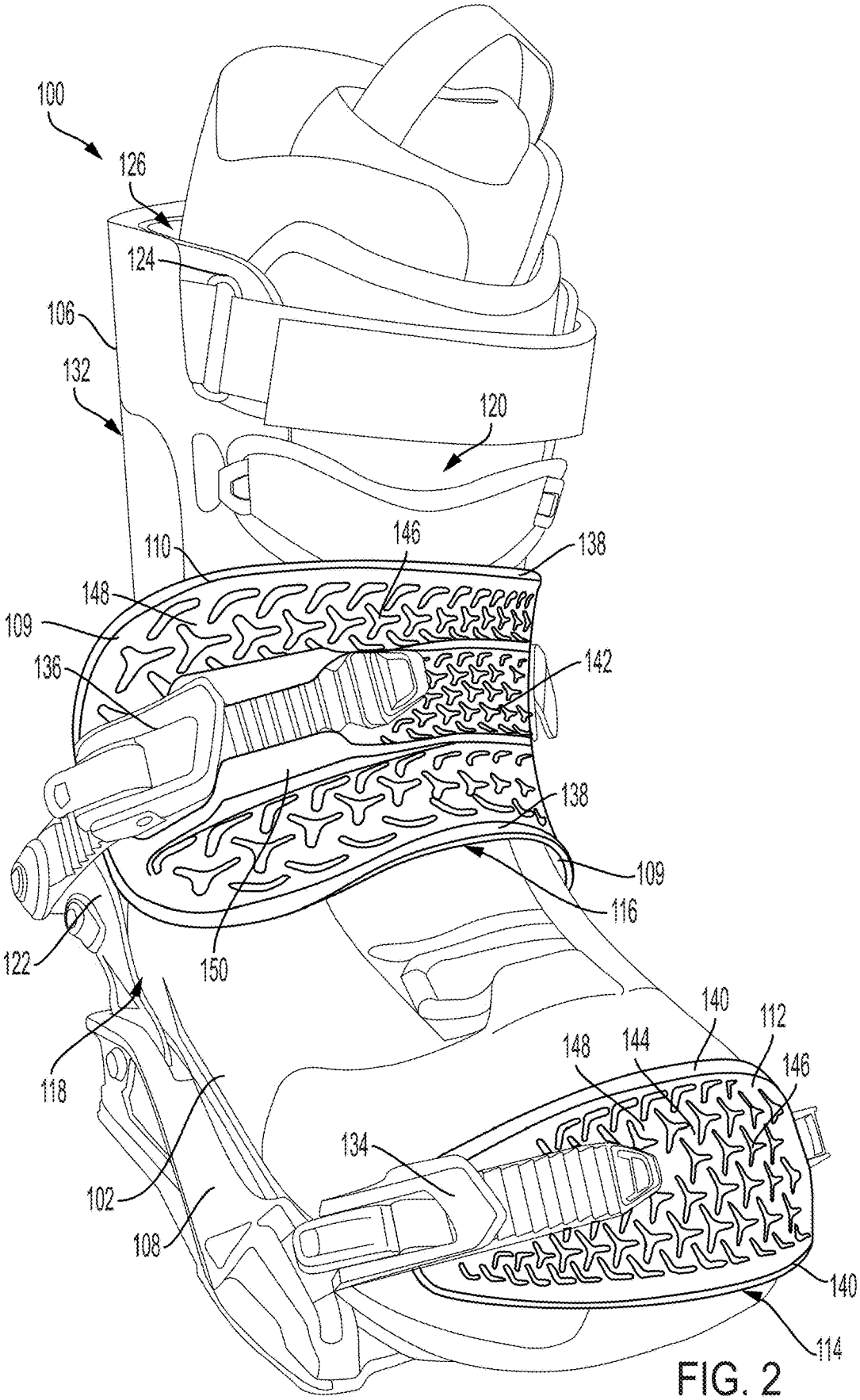
FIG. 2 is a perspective view of the snowboard binding securing the boot of FIG. 1.
Figure 3:
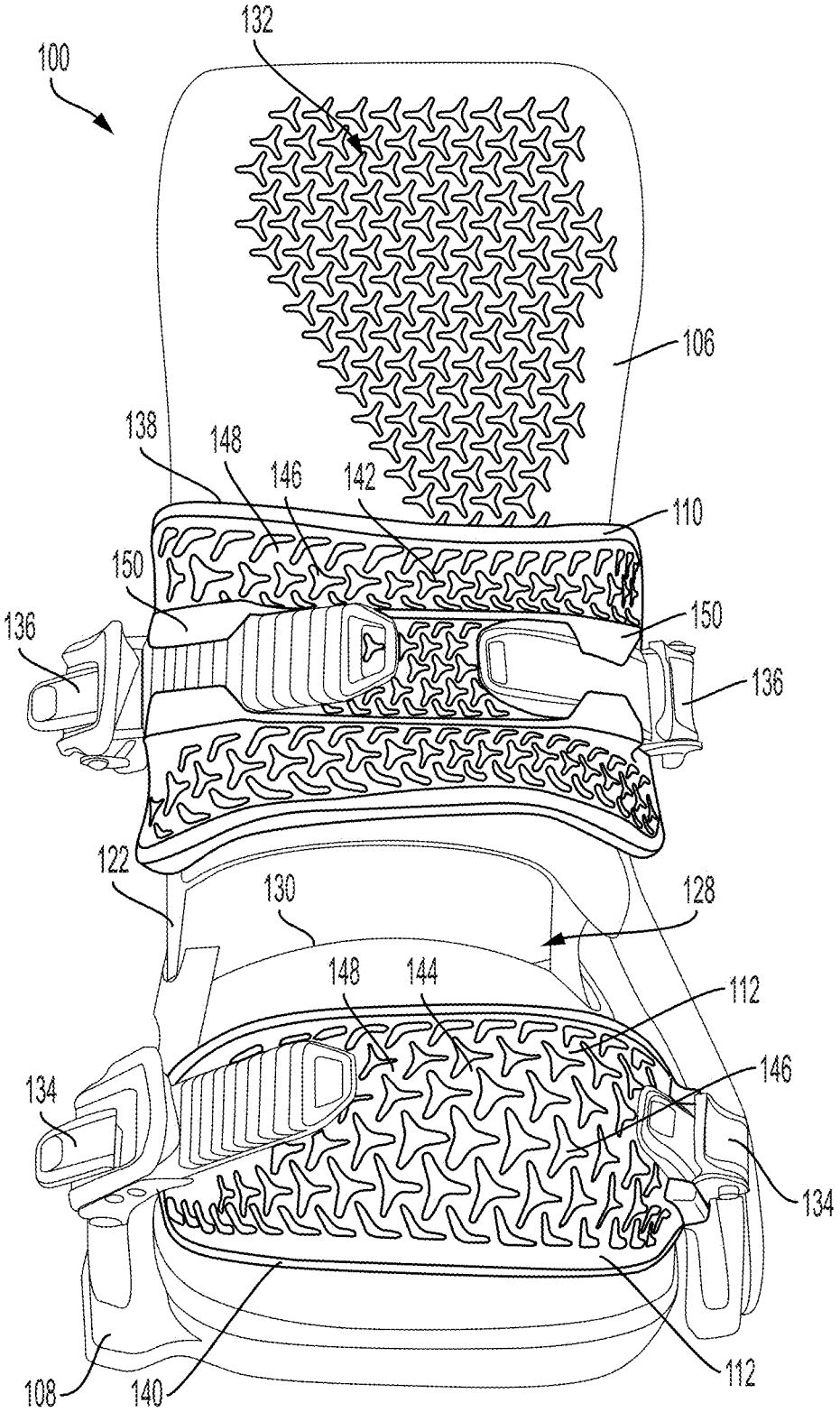
FIG. 3 is a front view of the snowboard binding of FIG. 1 with no boot.
Figure 4:
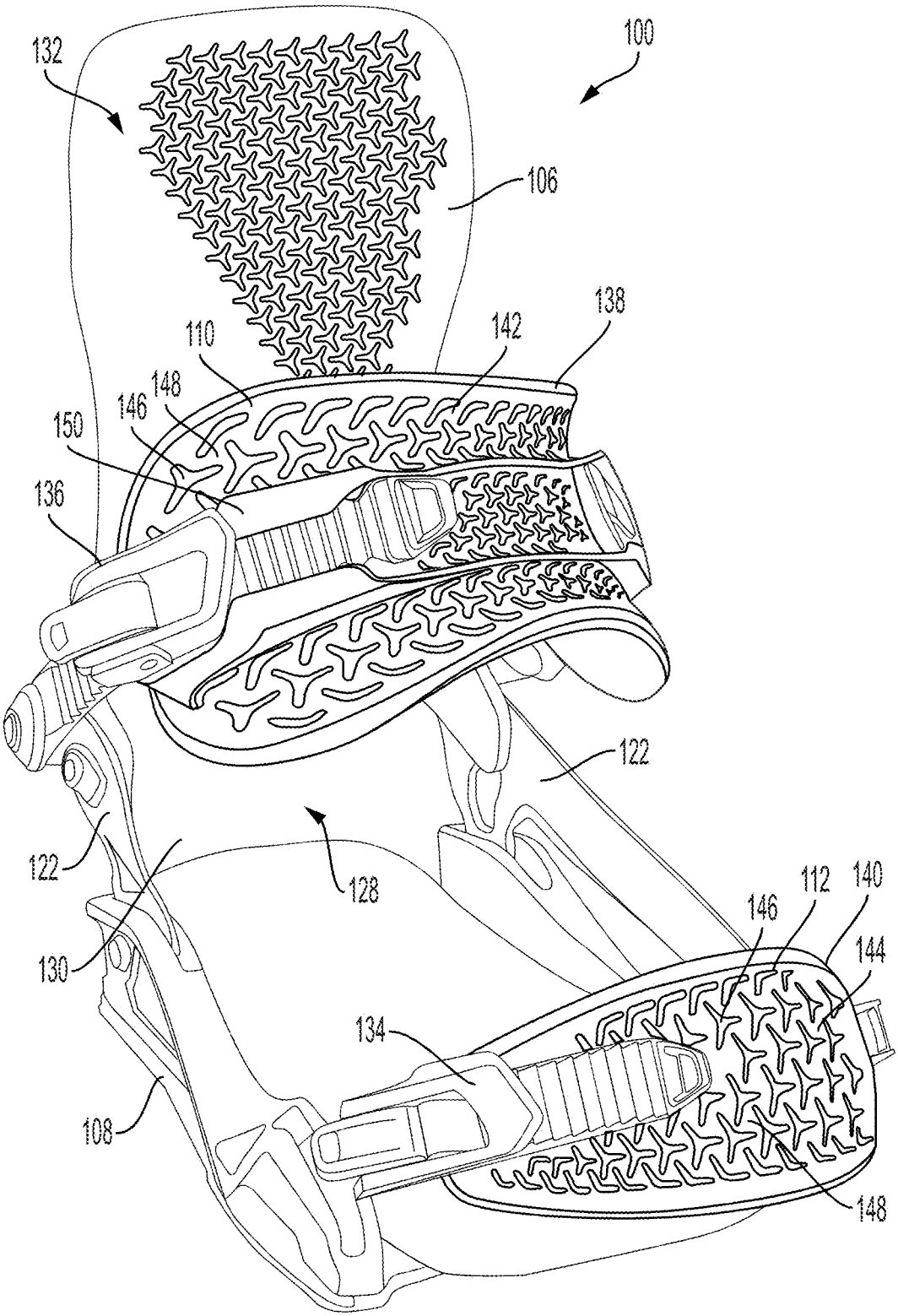
FIG. 4 is a perspective view of the snowboard binding of FIG. 1 with no boot.
Figure 5:
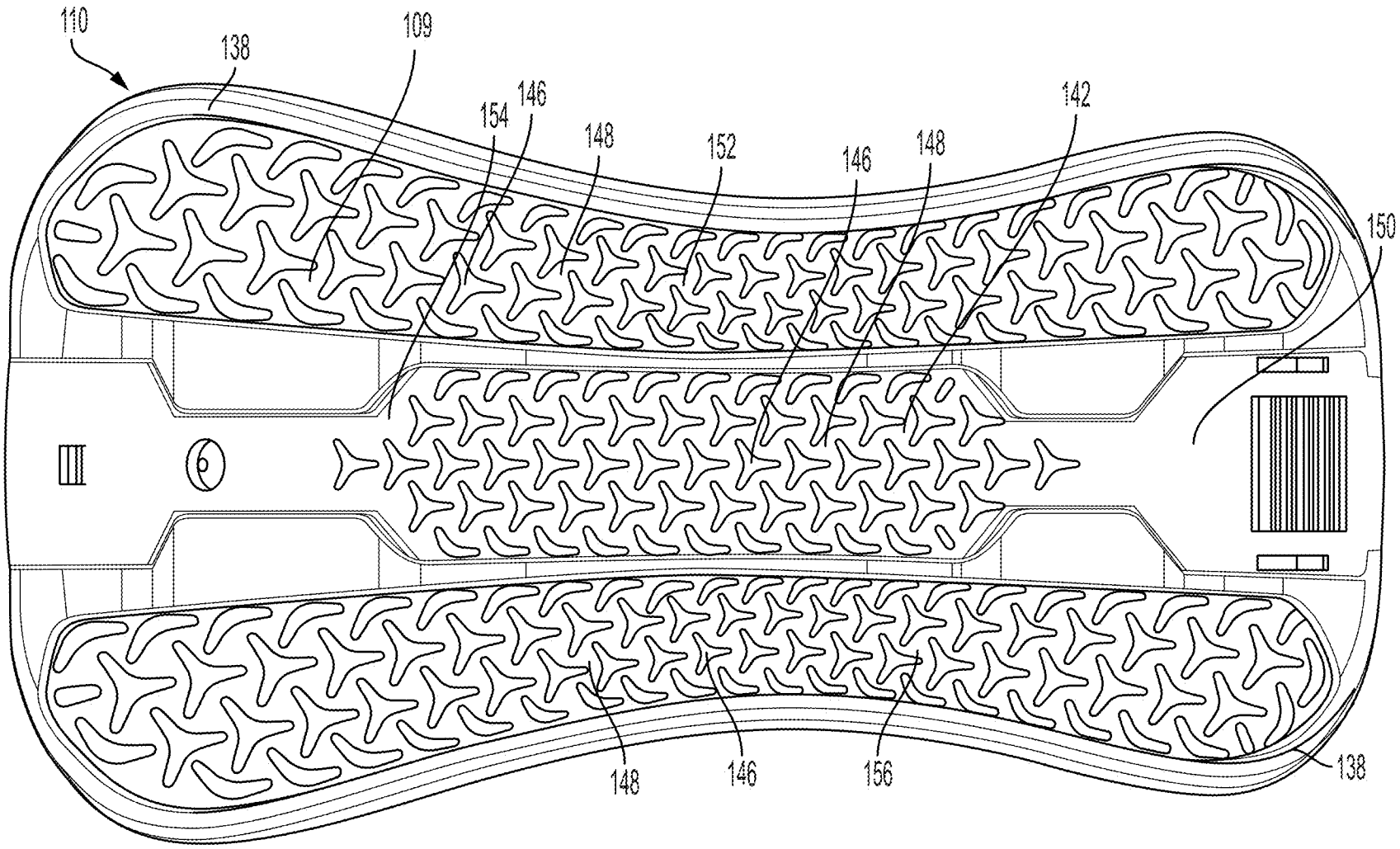
FIG. 5 is a front view of an ankle strap in accordance with the subject technology.
Figure 6:
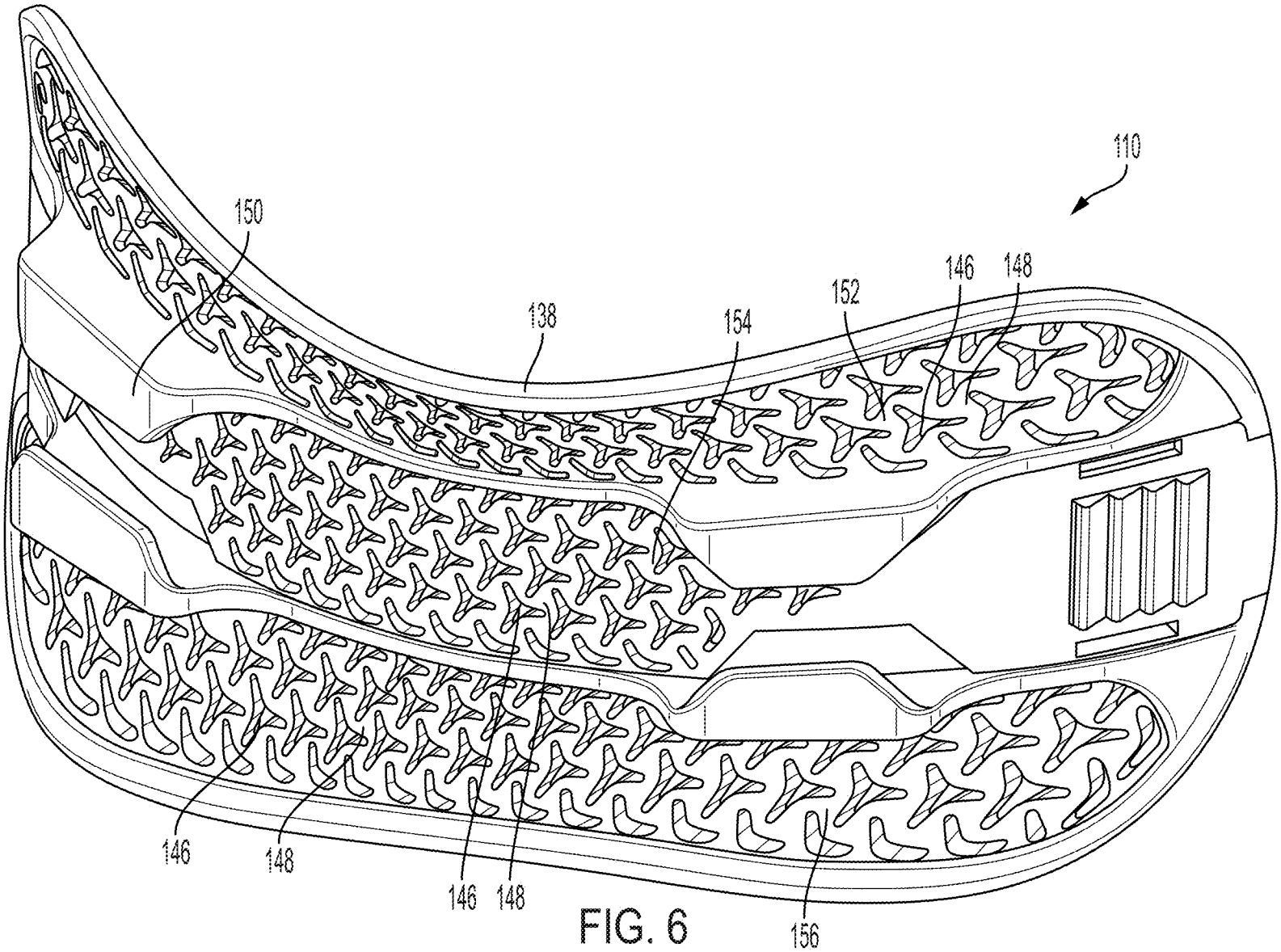
FIG. 6 is a perspective view of the ankle strap of FIG. 5.
Figure 7:
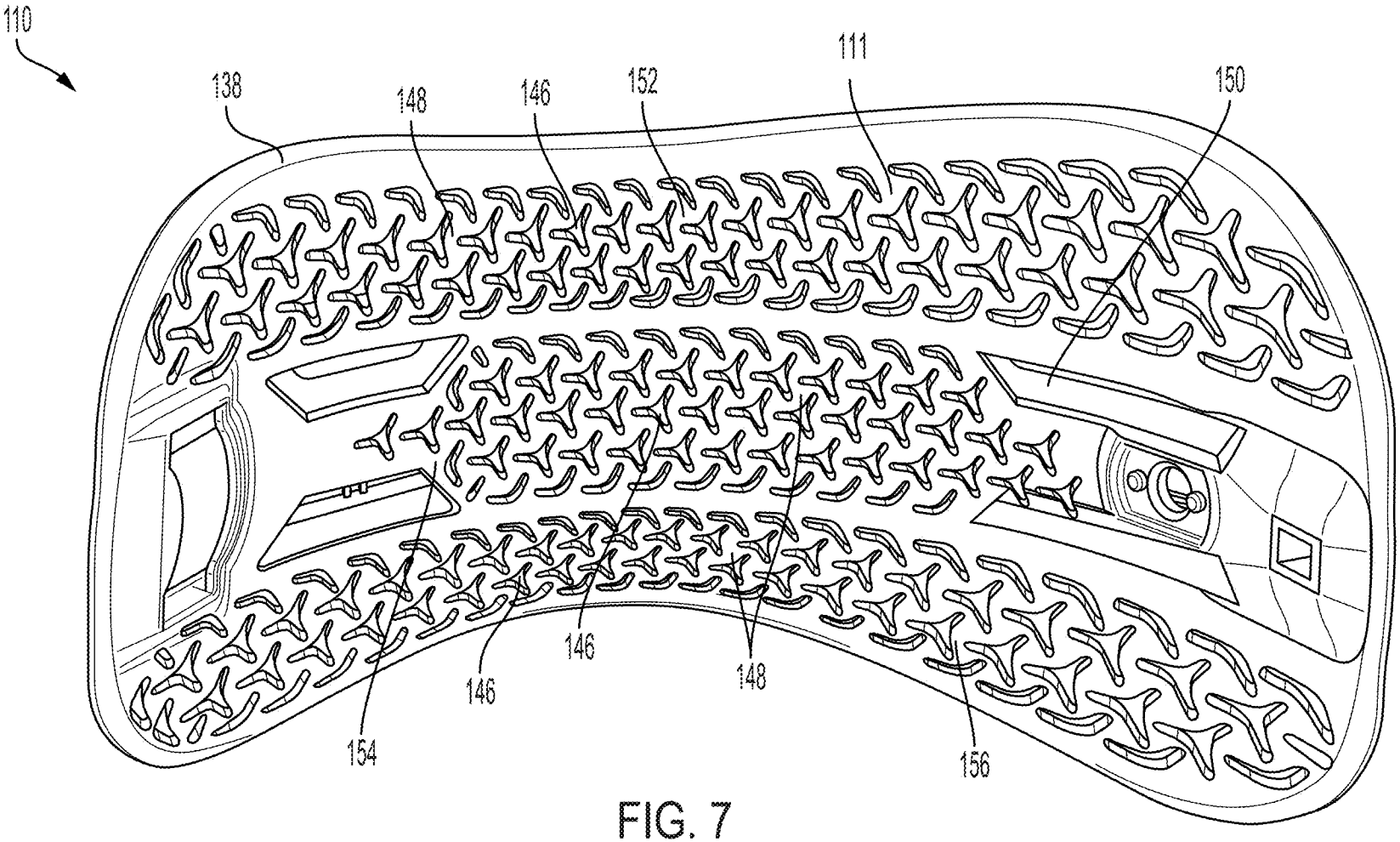
FIG. 7 is a rear view of the ankle strap of FIG. 5.
Figure 8:
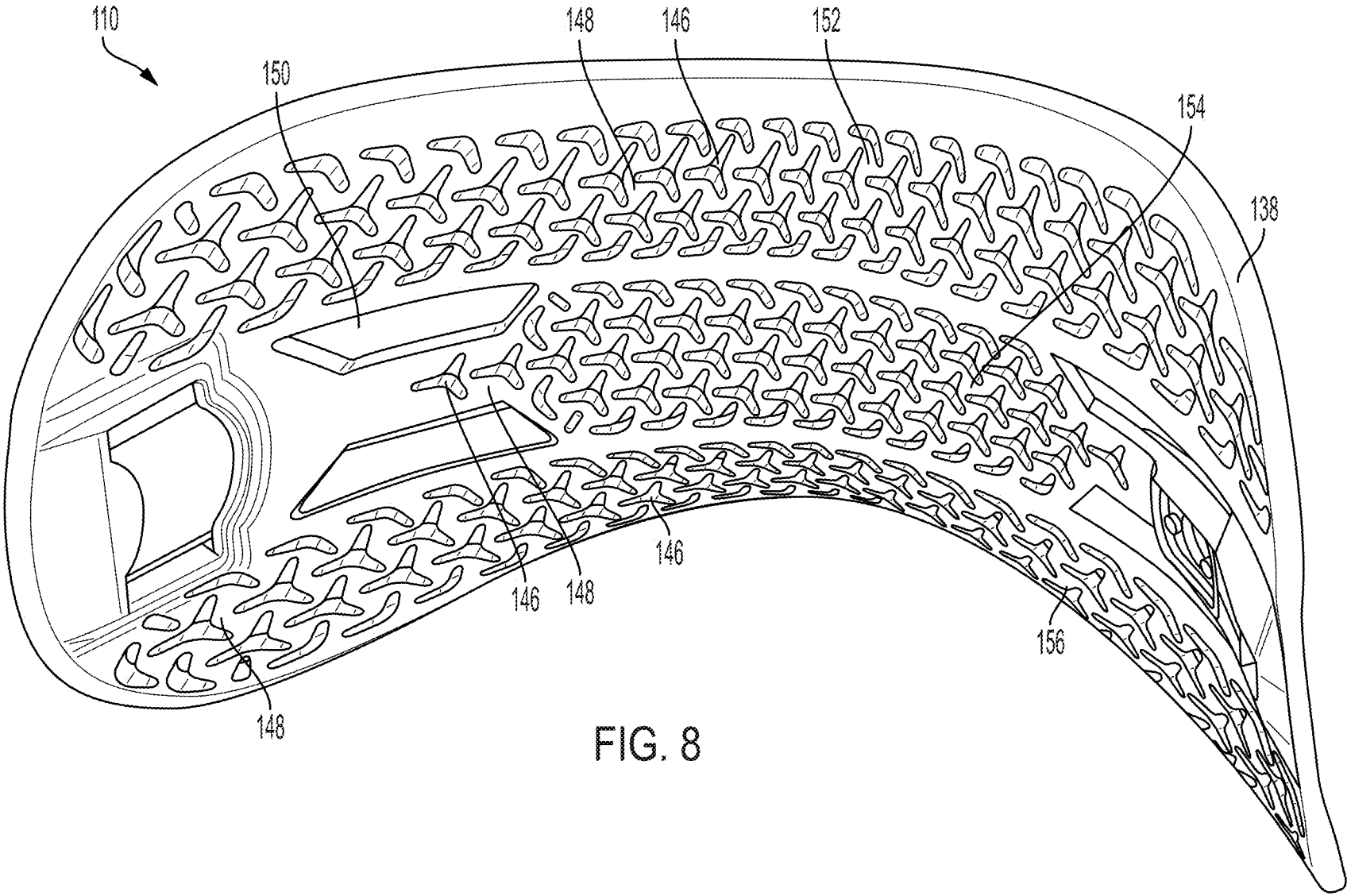
FIG. 8 is a rear perspective view of the ankle strap of FIG. 5.

Referring now to FIGS. 1-4, a snowboard binding 100 in accordance with the subject technology is shown. In FIGS. 1-2, the snowboard binding 100 is shown coupled to a boot 102, while in FIGS. 3-4 the snowboard binding 100 is shown by itself. The snowboard binding 100 includes a highback 106, a baseplate 108, and auxetic straps 110, 112 which secure the boot 102 within the binding 100, as discussed in more detail below. The binding 100 shown is for an exemplary binding for a right foot snowboard boot in accordance with the subject technology, it being understood that a binding for a left foot snowboard boot in accordance with the subject technology would mirror the right foot binding. Notably, while no boot 102 is shown in FIGS. 3-4 for better illustration of other components, the straps 110, 112 remain shown in compression and/or tension as if affixed around a boot 102 as in FIGS. 1-2.

Still referring to FIGS. 1-4, the baseplate 108 forms the bottom portion of the binding 100 and allows a rider to mount the snowboard binding 100 to a snowboard (not shown). When a rider places their boot 102 into the binding 100, the baseplate 108 is the base which the bottom of the rider's boot contacts. For ease of explanation herein, the boot 100 will be described as having a toe region 114, ankle region 116, heel region 118, and high ankle region 120. After the rider inserts their foot into the boot 102, the toe region 114 is proximate to the location expected of a rider's toe, the ankle region 116 is proximate to the expected location of the rider's ankle, the heel region 118 is proximate to the location expected of the rider's heel, and the high ankle region 120 is proximate to the location expected rider's lower leg above the heel and ankle regions 118, 116.

The highback 106 is an upright support member which is fixedly coupled to the baseplate 108 via connectors 122, the highback 106 extending upward from (i.e. perpendicular to) the baseplate 108. The highback 106 has an inward curve 124 which forms a cavity 126 within which the boot 102 can be positioned. A lower portion 128 of the highback 106, proximate the baseplate 108, includes a heelcup 130 configured to secure the heel region 118 of the rider's boot 102. An upper portion 132 of the highback 106 is designed to run adjacent to, and secure, the high ankle region 120 of the rider's boot 102.

The highback 106 also includes corresponding lower and upper fasteners 134, 136 which attach to toe and ankle straps 112, 110, respectively. More particularly, when a boot 102 is positioned within the highback 106, the ankle strap 110 can be placed across the ankle region 120 of the boot 102, which generally corresponds to a rider's ankle, such that the ankle strap 110 extends across the cavity 126 of the highback 106. The ankle fasteners 136 can then securely fasten the ankle strap 110 to opposite sides of the highback 106, and therefore across the ankle region 116 of the boot 102, while still allowing the rider to manually make adjustments for comfort. Similarly, the toe strap 112 can be placed across the toe region 114 of the boot 102. The lower fasteners 134 can then securely fasten the toe strap 112 at either side of the toe region 114 of the boot 102 to secure the boot 102 (the fasteners 134 being connected directly to the baseplate 102) while still allowing the rider to manually make adjustments.

The toe strap 112 can be made up of an injected frame of thermoplastic polyurethane or thermoplastic polyester elastomer. The toe strap 112 can then have a secondary elastomeric or stitched synthetic material (e.g. polyurethane) which creates the central grip of the toe strap 112 when the toe strap 112 stretches to the toe region 114 of the boot 102. The toe strap 112 can be formed through injection into a 3D shape, meaning a one piece injection with a predetermined shape or a two-piece injection with or without a predetermined shape. A 3D shape helps the central material of the strap 112 form to the snowboard boot 102, as discussed in more detail below. Since snowboard boot toe box shapes in the toe region 114 can have a range of heights, lengths, and curvature, the auxetic pattern allows the toe strap 112 to cup and hold the toe region 114 no matter the shape of the boot 102. This means a better connection between the binding 100 and snowboard. In snowboards found in the prior art, rigid components can result in significant stress during use which can cause the parts to separate or fail. By contrast, when toe straps are injected to a pre-determined shape, they often are unable to effectively form to snowboard boots, particularly where snowboard boots of different brands or models can vary in shape and size. The ankle strap 110 serves a different purpose than the toe strap 112, the ankle strap 110 being designed to flex around the inwardly curved boot 102 in the ankle region 116. Yet the ankle strap 110 likewise includes an auxetic pattern and can be made from the same materials as the toe strap 112 to allow the ankle strap 110 to form to the boot 102 and flex.

The straps 110, 112 each include a solid perimeter 138, 140 (i.e. with no auxetic pattern) which surrounds an interior area 142, 144 of the respective strap 110, 112 and provides support. The solid perimeters 138, 140 will generally be designed with a greater rigidity than the interior area to prevent outward expansion of the perimeter of the strap 110, 112, while the interior areas 142, 144 are designed to expand or compress. In some cases, each entire strap 110, 112, including the solid perimeters 138, 140 and interior areas 142, 144 are formed from the same type of material. Therefore the differing rigidities can be accomplished by designing each solid perimeter 138, 140 to be thicker than the respective interior area 142, 144, while the interior areas 142, 144 also include apertures forming the auxetic pattern to allow expansion or compression.

In comparison to the straps 110, 112, the highback 106 is a relatively rigid material, such as a stiff plastic, which supports the rider's boot 102 when the straps 110, 112 fasten the boot 102 within the binding 100. The highback 106 can be a nylon injection or a composite blend, such as a glass or carbon filled injection. The highback 106 can also be a compressed or forged composite with post processes to add mounting and/or assembly holes to affix to the other binding 100 chassis components. In some cases, a highback 106 with a composite glass fiber Polyethylene terephthalate glycol-modified lamination upper portion 132 and an overmolded Nylon lower portion 128 has been found to be effective. An auxetic pattern can then be included on the upper portion 132 to allow for targeted flex, as discussed in more detail below. If no auxetic pattern is included, the highback 106 would maintain stiffness and response from the materials described above or from other design changes such as surface ribbing and/or material thickness changes.

The highback 106 could also an inner pad to wrap, hug, or dampen vibrations with the boot 102. This pad could be a compression molded Ethylene-vinyl acetate, injection nylon, thermoplastic elastomer, or thermoplastic polyurethane, for example. The pad can be attached directly to the highback 106, and for all purposes herein is considered part of the highback 106. Therefore it should be understood that any pad on the highback 106 can be considered part of the highback 106, including the auxetic pattern as discussed with respect to the highback 106, and a separate pad is not discussed in further detail herein. Notably, all materials discussed herein are by way of example only, and one of skill in the art would understand that other materials might be used to the same or similar effect.

In general, the auxetic pattern allows the corresponding area (e.g. interior area 142, 144 of the straps 110, 112) to flex while still supplying enough structural support to secure the boot 102 within the binding 100. Auxetic patterns are defined by a plurality of apertures 146, or holes, through the surrounding structural supporting material 148. The auxetic pattern in the material created by the apertures 146 results in a negative Poisson's for the material as a whole, or for the particular area which has the auxetic pattern. This means that when stretched, the area of the auxetic pattern becomes thicker, rather than thinner, perpendicularly to the applied force. Further, the material itself (i.e. the supporting material 148 between the apertures 146) does not necessarily need to stretch, or does not stretch very much, when force is applied to the straps 110, 112. This is because when force is applied, the auxetic pattern is pulled and the apertures 146 tend to be initially rearranged, the structural material 148 of the strap 110, 112 being reoriented before the structural material 148 itself is forced to stretch.

The apertures 146 can tend to vary in size. For the toe strap 112, the apertures 146 tend to be larger nearer the center of the pattern, or nearer the center of the strap 112, which allows the region around the center to expand to conform to the toe region 114 of the boot 102 while the periphery (nearest the solid perimeter 140) is more restricted from enlarging or stretching. In particular, this allows the toe strap 112 to expand outwardly near its center to cup the 3D shape of the toe region 114 of the boot 102, while still maintaining a substantially unchanged perimeter 140.

Referring now to FIGS. 5-8, the ankle strap 110 is shown separate from the binding 100 and boot 102 to more clearly highlight the interior area 142 with an auxetic pattern. Notably, while certain advantageous aspects of the auxetic patterns shown herein are discussed, in different embodiments, other types of auxetic patterns could also be used in accordance with the subject technology. The particular auxetic patterns shown herein are for exemplary purposes only, and are not meant to limit the subject technology to a particular type of auxetic pattern.

The ankle strap 110 includes a mount assembly 150 which couples with the upper fasteners 136 to attach to the ankle strap 110 in order to adjustably couple the ankle strap 110 to the highback 106. The interior 142 of the ankle strap is divided into three sections which include auxetic patterns: an upper section 152 above the mount assembly 150; a lower section 156 below the mount assembly 150; and a middle section 154 which runs adjacent to the mount assembly 150 (and ultimately, adjacent the ankle fasteners 136 across the strap 110, when attached). Within each section 152, 154, 156, the auxetic pattern is defined by structural support material 148 disposed between apertures 146. The apertures 146 nearer the center are formed from three prongs extending from a center of each aperture 146. The auxetic pattern apertures 146 are generally largest around the center of each section 152, 154, 156 with the full desired auxetic pattern being realized in those areas and the size of the apertures 146 gradually reducing the nearer the apertures 146 are located to the perimeter of each section 152, 154, 156 (alternatively, in some cases, the auxetic pattern apertures 146 can be largest near the center of the entire strap 110 with the aperture 146 size gradually reducing from there). The apertures 146 adjacent to the perimeter 138 at each section 152, 154, 156 are smaller than the center apertures 146 and at times the apertures 146 form an incomplete pattern design. For example, part of the auxetic pattern near the perimeter 138 is formed by single pronged straight apertures 146 and two pronged apertures 146 (e.g. substantially in the shape of a boomerang). Notably, a similar auxetic pattern is on the toe strap 112 on FIGS. 1-4, without the separation into the three sections 152, 154, 156.

Still referring to FIGS. 5-8, the solid perimeter 138 surrounds the interior area 142 which includes the entire auxetic pattern on the ankle strap 110. The solid perimeter 138 is a more rigid portion of the strap 110 which resists expansion in the direction of the periphery (i.e. the perimeter 138) of the strap 110. When force is applied from the rider's boot 102, such as when making a turn, the auxetic pattern will tend to expand in the general plane of the strap 110, but being restricted by the perimeter 138, will appear to stretch perpendicularly to the general plane of the strap 110 rather than expanding outwardly around the periphery. The meaning of "general plane" should be understood to refer herein to the shape formed by one of the straps 110, 112, which is not completely planar due to the fact that the straps 110, 112 do not lie perfectly flat when in use, being that they will be positioned to extend across a region of the boot 102. For the ankle strap 110, when the rider leans into a toe side turn, the auxetic pattern of the ankle strap 110 tends to compress on the outermost surface 109 (i.e. facing away from the boot 102) while the inner surface 111 (i.e. facing the boot 102) expands similar to the toe strap 112. To accomplish this, the apertures 146 on the ankle strap 110 tend to be smaller nearer the center of the pattern and larger nearer the periphery (nearest the solid perimeter 138). This is to allow the ankle strap 110 to flex inwardly to form to the inward flex of the ankle region 116 of the boot 102. In this way, the auxetic pattern reduces pressure points on the rider's foot since it is able to conform around the snowboard boot.

Referring again to FIGS. 1-4, like the ankle strap 110, the toe strap 112 can be relatively flexible to stretch along the general plane of the toe strap 112, and expand in the direction perpendicular to the general plane of the toe strap 112 (i.e. perpendicularly away from the surface of the toe strap 112). In contrast to the ankle strap 110, the toe strap 112 uses smaller exterior apertures 146 to limit the strap 112 from expanding in the general plane of the strap 112 further from the center, and instead encourage force from the rider's boot 102 to be translated into stretching the auxetic pattern in the general plane of the strap and away from the rider's boot 102 near the center of the strap 112, as discussed in more detail below. Notably, it is also possible for the straps 110, 112 to have no solid perimeter 138, 140, in which case the auxetic pattern can extend to the edge of the straps 110, 112 if desired.

Unlike the ankle strap 110, the toe strap 112 includes a single, uninterrupted interior region with an auxetic pattern within the solid perimeter 140. The apertures 146 of the toe strap 112 are sized based on proximity to the perimeter 140, with the apertures 146 gradually reducing in size from the center of the strap 112 to the perimeter 140. This helps prevent the outside of the toe strap 112 from stretching by making the perimeter 140 more rigid. This also enlarges the forces nearer the central area of the auxetic pattern to cup the toe region 114 of the snowboard boot 102. Cupping the toe region 114 of the boot 102 in this manner is extremely beneficial in that it allows the toe strap 112 to apply an inward and downward force to the boot 102 (i.e. to the top surface and front surface of the toe region 114 of the boot 102), forcing the boot 102 back into the heelcup 130 of the binding 100. Due to the relative rigidity of the perimeter 140 of the toe strap 112, the perimeter 140 resists stretching during this process, which keeps the toe region 114 cupped, while the stretched auxetic pattern is forced in the direction perpendicular to the toe strap 112 (i.e. away from the toe region 114 of the boot 102). Furthermore, the flexibility and expandability of the toe strap 112 allows it to conform to the boot 102 and keeps it secured around the boot toe region 114. This keeps the snowboard boot 102 from slipping or moving into the binding 100 and maximizes the connected-comfort and response of the boot-to-binding-to-snowboard interface.

Figure 9:
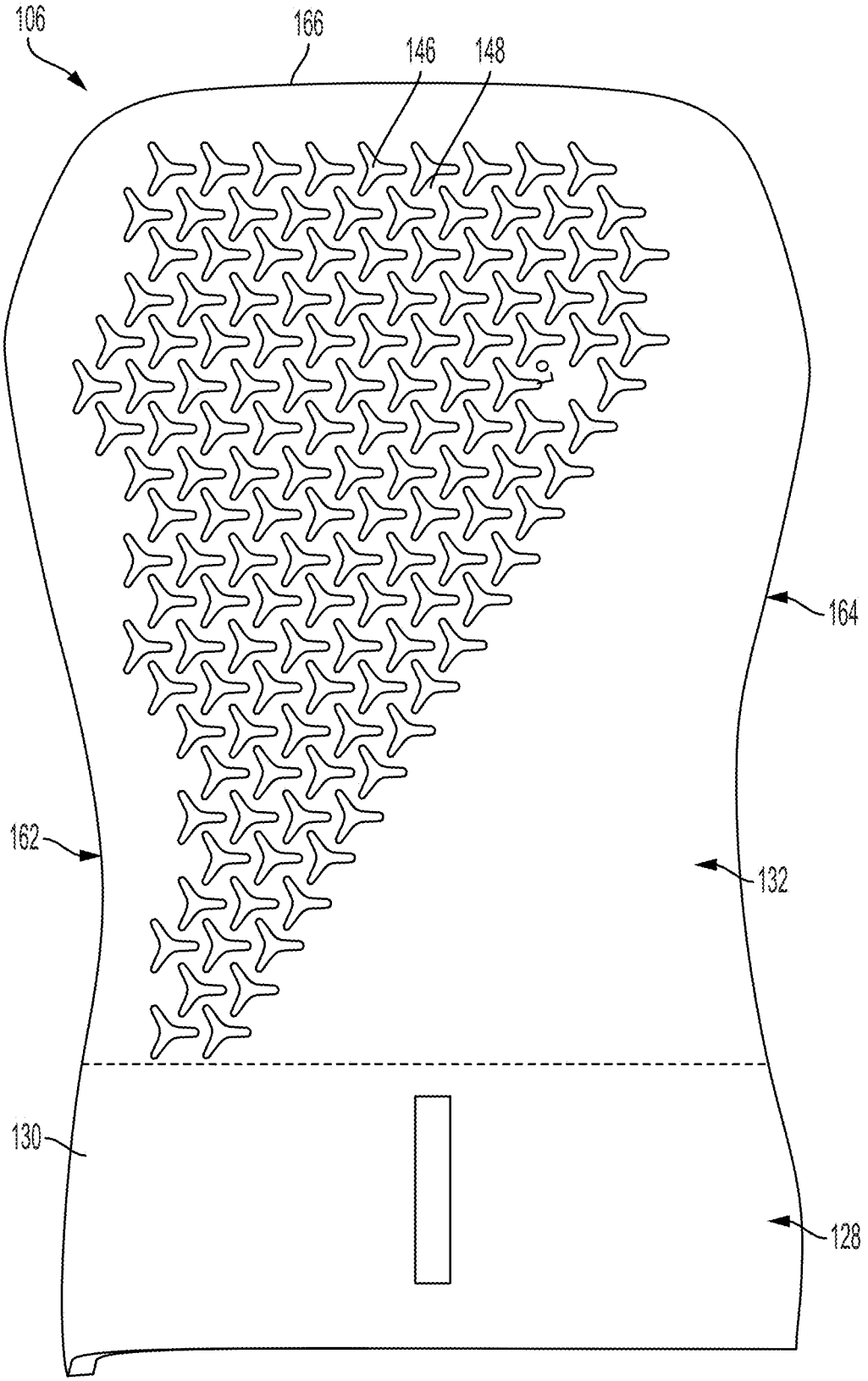
FIG. 9 in rear view of a highback in accordance with the subject technology.

Referring now to FIGS. 1-4 and 9, the function of the highback 106 is now discussed in greater detail. In FIG. 9, the highback 106 is shown separated from the other components of the binding 100 for better illustration. Like the straps 110, 112, the highback 106 has an auxetic pattern formed from apertures 146 through supporting material 148, the apertures 146 defined by three pronged holes extending from a center. Notably, other known auxetic patterns can also be used. For ease of explanation, the highback 106 can be described as divided into two portions: a lower portion 128; and an upper portion 132. By way of example, the upper portion 132 can be the upper two thirds of the highback 106, with the remaining third being the lower portion 128. The lower portion includes the heelcup 130 and is configured to support the heel region 114 of the boot 102. The upper portion 132 is distal to the heelcup 130 and extends upwardly from the lower portion 128, away from the where the binding 100 connects to the baseplate 108.

It is normally desirable to have some amount of flex in the upper portion 132 of the highback 106. As such, the auxetic pattern is contained in the upper portion 132 of the highback 106, where more flexure is desirable, and flexibility can provide comfort for the rider. The auxetic pattern allows the upper portion 132 of the highback 106 to flex, particularly in response to increased force from the rider (e.g. when executing a turn), by allowing the auxetic pattern to stretch. Since the auxetic pattern allows for some flexure, less stress is applied to the structural material 148 in the upper portion 132 of the highback 106 which would otherwise absorb that force, stretching the material and running the risk of a material failure.

The highback 106 also includes an inward edge 162 and an outward edge 164. Since the exemplary highback 106 is for a right side binding and FIG. 9 is a rear view, the inward edge 162 is on the left side of FIG. 9 and the right side of FIGS. 1-4. In this example, the auxetic pattern is the most prevalent along the inward edge 162 and an upper edge 166 of the upper portion 132 of the highback 106 and runs adjacent to the entire inward edge 162 and upper edge 166, as those areas are expected to experience the most force, require the most flexure, and benefit from a highback 106 which allows for some torsional flexibility. Thus, including the auxetic pattern adjacent to the entire inward edge 162 and upper edge 166, or to a significant portion of those edges 162, 166, can ensure flex where most desirable on the highback 106. In some cases, the pattern of the apertures 146 can form a substantially triangle shape, as shown in FIG. 9, with a base leg running along the upper edge 166, a height leg running along the inward edge 162 and connecting to the base leg, and a third leg extending across the center of the upper portion 132 to connect the base leg and the height leg. The entire area of the triangle can include apertures 146 for the auxetic pattern. By contrast, the area of the upper portion 132 furthest from the inner and upper edges 162, 166 have no apertures 146 to provide increased structural support. Increased support and less flexibility has been found advantageous in the lower portion 128 as well, as the lower portion 128 needs to maintain a solid and stable connection to the other components of the binding 100 chassis.

Notably, one or more of the straps 110, 112 designed in accordance with the subject technology, can be implemented on a snowboard binding alone, or in combination with, the highback 106 described in accordance with the subject technology. In at least one example of the subject technology, the binding includes an ankle strap, toe strap, and highback which all include portions with auxetic patterns.

Figure 10A:
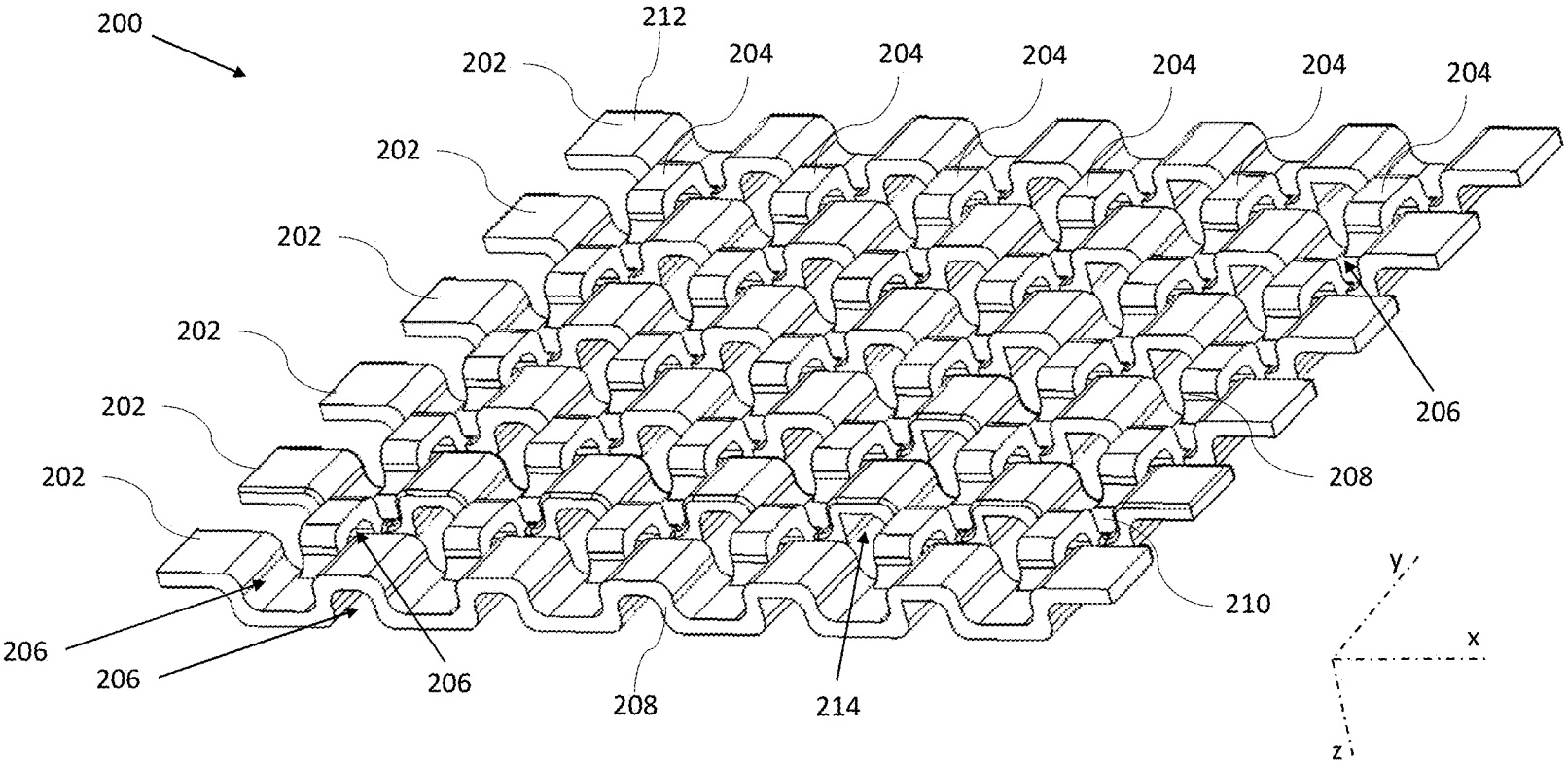
FIG. 10*a* is a top perspective view of a hinged auxetic pattern in accordance with the subject technology.
Figure 10B:
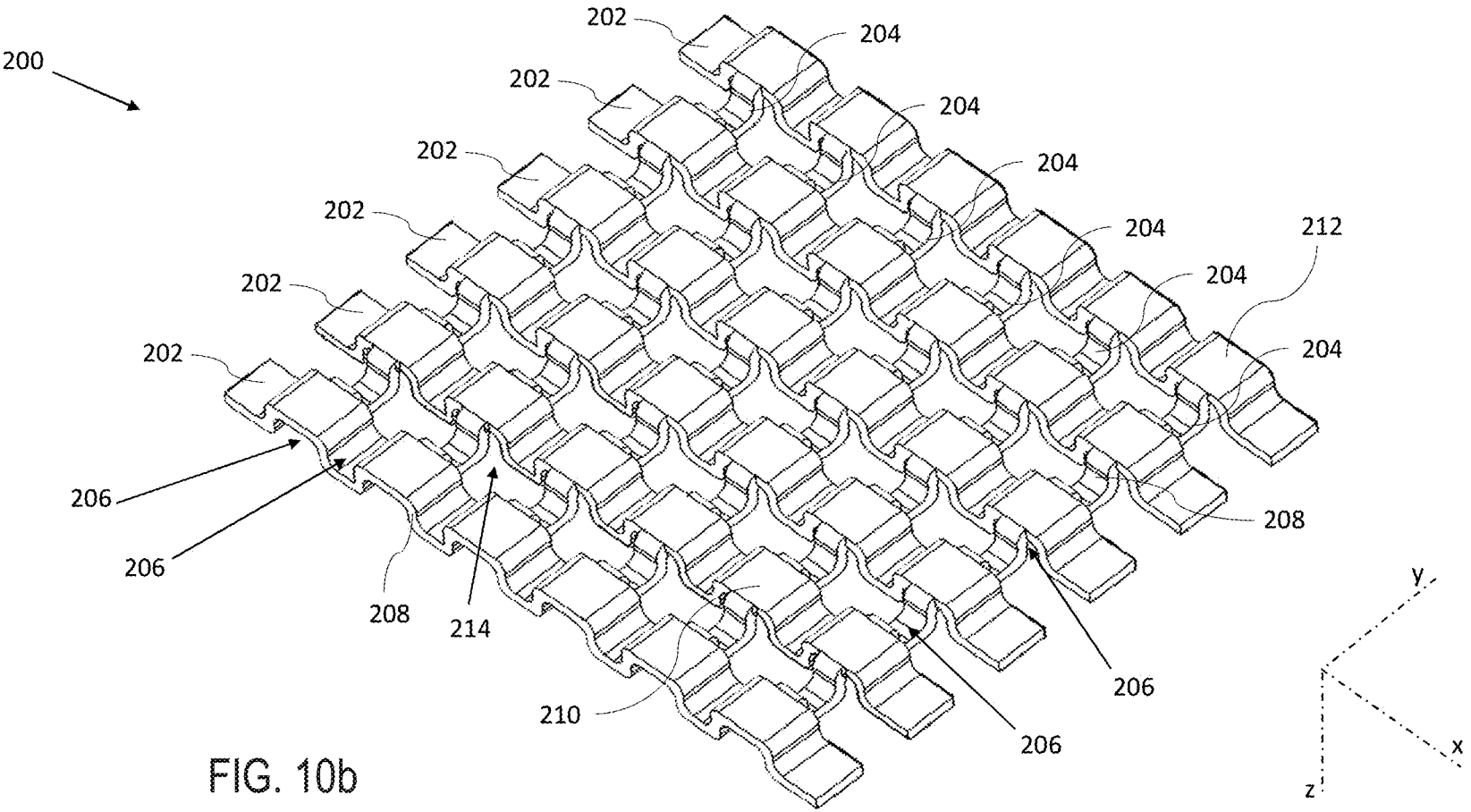
FIG. 10*b* is a bottom perspective view of the hinged auxetic pattern of FIG. 10*a*.

Referring now to FIGS. 10*a-b*, a material forming a 3D, or hinge auxetic pattern 200, in accordance with the subject technology, is shown. The auxetic pattern is formed by supporting material 212 surrounding supporting apertures 214, which could be used to replace, or supplement, the other auxetic patterns discussed herein. In particular, apertures 146 and supporting material 148 could be replaced with the apertures 214 and supporting material 212, respectively, in any of the auxetic patterns on the ankle straps 110, toe straps 112, or highback 106.

In general, while the material of the patterns shown in FIGS. 1-9 is designed to stretch in the general plane of auxetic pattern (i.e. the x-y plane), the pattern 200 can also expand along the axis that runs orthogonal to the plane of the pattern 200 (i.e. the z axis). This is due to the hinge structure of the pattern 200 which allows for expansion in any direction. The particular pattern 200 shown in FIGS. 10*a-b* includes a structure with a plurality of strips 202 running in the direction of the x-axis and intersecting a plurality of strips 204 running in the direction of the y-axis such that the strips 202, 204 run orthogonally to one another and form hinges, as discussed below. Each strip 202, 204 is comprised of a series of U-shaped arcs, with alternating openings 206 facing in opposite directions along the z-axis. In the interior of the pattern 200, the side members 208 of each U-shaped arc having an opening 206 facing in one direction are shared with a U-shaped arc with an opening 206 facing in the opposite direction. Further, the base member 210 of every other U-shaped arc of the x-direction strips 202 is shared by, and acts as a based member 210 for a U-shaped arc of a y-direction strip 204. Notably, the pattern 200 is exemplary of just one hinge type pattern which has been found to be effective. Alternative patterns using a similar hinge structure can be also used, and can replace the auxetic pattern of the straps 110, 112 or highback 106, in accordance with the subject technology. In general, patterns with hinge structures are particularly designed for stretching in an axis orthogonal to the surface (or general plane) of the material.

All orientations and arrangements of the components shown herein are used by way of example only. Further, it will be appreciated by those of ordinary skill in the pertinent art that the functions of several elements may, in alternative embodiments, be carried out by fewer elements or a single element. Similarly, in some embodiments, any functional element may perform fewer, or different, operations than those described with respect to the illustrated embodiment. Also, functional elements (e.g. connectors, fasteners, and the like) shown as distinct for purposes of illustration may be incorporated within other functional elements in a particular implementation.

While the subject technology has been described with respect to preferred embodiments, those skilled in the art will readily appreciate that various changes and/or modifications can be made to the subject technology without departing from the spirit or scope of the subject technology. For example, each claim may depend from any or all claims in a multiple dependent manner even though such has not been originally claimed.

What is claimed is:

1. A snowboard binding comprising:

a highback configured to form an inward curve to define a cavity for a boot; and at least one strap configured to secure the boot within the cavity, wherein:

at least one of the following includes an auxetic pattern: the highback; and the at least one strap; and the auxetic pattern is a hinge pattern with hinges formed between structural material, the hinges configured to flex in a direction orthogonal to a general plane of the structural material.

2. The snowboard binding of claim 1, wherein the hinge pattern is formed by: a first plurality of strips extending in a series of U-shaped arcs along a first axis of the general plane; and a second plurality of strips extending in a series of U-shaped arcs along a second axis of the general plane and intersecting with the first plurality of strips, the second axis being orthogonal to the first axis.

3. A snowboard binding comprising:

a highback configured to form an inward curve to define a cavity for a boot;

an ankle strap configured to extend across the cavity and connect to the snowboard binding on opposite sides of the inward curve to secure the boot within the cavity; and a toe strap configured to extend across a toe region of the boot to secure the boot within the cavity, wherein:

the toe strap includes a first solid perimeter surrounding a first interior portion, the first interior portion forming an auxetic pattern; and the auxetic pattern of the toe strap is formed from a plurality of apertures through the toe strap, the plurality of apertures having a size based on proximity to the solid perimeter, with apertures more proximate to the solid perimeter having a smaller size.

4. The snowboard binding of claim 3, wherein the solid perimeter of the toe strap has a greater rigidity than the first interior such that the solid perimeter of the toe strap resists expansion as compared to the first interior.

5. The snowboard binding of claim 3, wherein the ankle strap includes a solid perimeter surrounding a second interior, the second interior forming an auxetic pattern.

6. The snowboard binding of claim 3, wherein the highback has a lower portion proximate to a heelcup and an upper portion distal the heelcup, the upper portion including an auxetic pattern.

7. A snowboard binding comprising:

a baseplate configured to mount the snowboard binding to a snowboard;

a highback configured to attach to the baseplate and having an inward curve forming a cavity configured to encircle a boot, the highback having: a first portion having a heelcup configured to support a heel region of the boot; and a second portion distal to the heelcup;

a toe strap configured to: extend across a toe region of the boot; and connect to the snowboard binding at opposite sides of the boot to secure the boot within the cavity, the toe strap including a first solid perimeter surrounding a first interior, the first interior forming a first auxetic pattern; and an ankle strap configured to: extend across the cavity; extend across an ankle region of the boot; and connect to the snowboard binding at opposite sides of the inward curve to secure the rider's ankle within the cavity, the ankle strap including a second solid perimeter surrounding a second interior, the second interior forming a second auxetic pattern, wherein:

the toe strap is configured such that when a boot is secured within the cavity, pressure applied to the toe strap by the boot causes the auxetic pattern of the first interior to apply a downward force to a top surface of a toe region of the boot and an inward force to a front surface of the toe region of a boot to cup the toe region and force the boot in a direction of the heelcup; and the auxetic patterns are formed from a plurality of apertures surrounded by supporting material.

8. The snowboard binding of claim 7, wherein the apertures of the auxetic pattern of the toe strap have a size based on proximity to the first solid perimeter, with apertures more proximate to the solid perimeter having a smaller size.

9. The snowboard binding of claim 8, wherein the toe strap is relatively rigid nearer the first solid perimeter to resist stretching in a general plane of the toe strap while being relatively flexible nearer a center of the first interior to allow stretching in a direction perpendicular to the general plane of the toe strap.

10. The snowboard binding of claim 8, wherein the ankle strap is relatively rigid nearer the second solid perimeter to resist stretching in a general plane of the ankle strap while being relatively flexible nearer a center of the second interior to allow stretching in a direction perpendicular to the general plane of the ankle strap.

11. The snowboard binding of claim 7, wherein in at least one of the auxetic patterns, a plurality of apertures proximate a central region of said auxetic pattern each include three prongs extending from a central portion of the aperture.

12. The snowboard binding of claim 7, wherein: the second portion of the highback includes an inner edge and an upper edge and an auxetic pattern runs adjacent to the entire inner edge and upper edge of the highback.

* * * * *